United States Patent [19]

Strachan

[11] Patent Number: 4,553,780

[45] Date of Patent: Nov. 19, 1985

[54] MATTRESS CARRYING HARNESS

[76] Inventor: Donald C. Strachan, 11969 Pendleton Rd., Yucaipa, Calif. 92399

[21] Appl. No.: 621,422

[22] Filed: Jun. 18, 1984

[51] Int. Cl.[4] ..... B65D 63/18

[52] U.S. Cl. ..... 294/152; 294/149; 294/155

[58] Field of Search ..... 294/67 BA, 67 EA, 74, 294/137, 141, 142, 149–157, 165

[56] References Cited

U.S. PATENT DOCUMENTS

| | | | |
|---|---|---|---|
| 618,333 | 1/1899 | Colteryahn et al. | 294/157 |
| 799,793 | 9/1905 | Kinsella | 294/155 |
| 873,044 | 12/1907 | Hanson | 294/74 |
| 2,508,795 | 5/1950 | Nielson | 294/152 |
| 3,214,072 | 10/1965 | Brown | 294/152 |
| 4,251,016 | 2/1981 | O'Rafferty et al. | 294/154 X |

FOREIGN PATENT DOCUMENTS

| | | | |
|---|---|---|---|
| 406541 | 11/1924 | Fed. Rep. of Germany | 294/149 |

*Primary Examiner*—Johnny D. Cherry

*Attorney, Agent, or Firm*—Christie, Parker & Hale

[57] ABSTRACT

A carrying harness apparatus for carrying or turning a mattress which can be tightened down on mattresses of varying sizes to provide lateral support for the mattress during carrying and secure handholds at several points about the periphery is disclosed. Two belts in the harness apparatus, which lie along opposite sides of the mattress, are adjustable in length to allow the harness to be tightened down and have releasable connectors for easy removal of the harness.

4 Claims, 8 Drawing Figures

Fig. 5
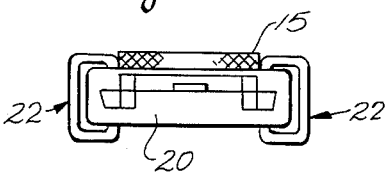
Fig. 6
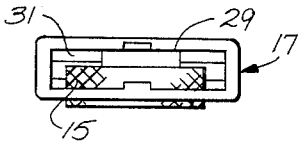
Fig. 7
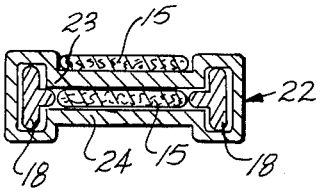
Fig. 3
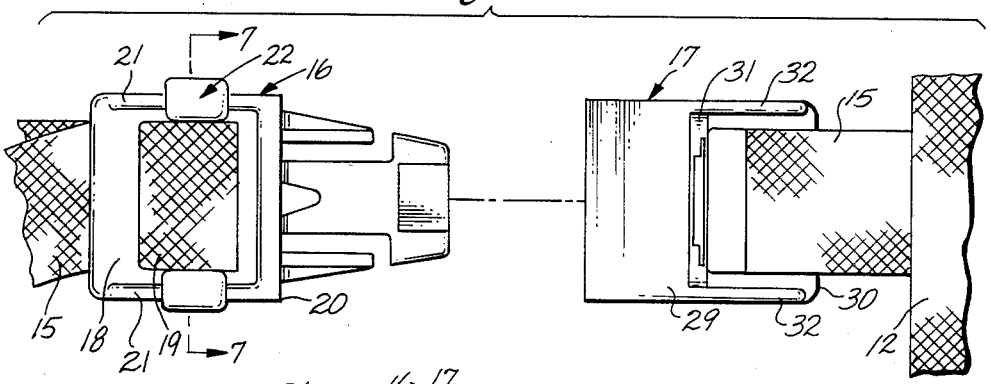
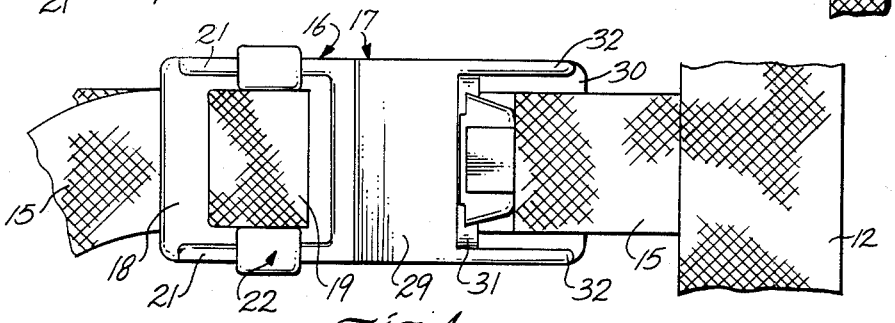
Fig. 4

MATTRESS CARRYING HARNESS

BACKGROUND OF THE INVENTION

Settling of upholstery materials in a new mattress causes slight body depressions to appear in the mattress surfaces. To minimize these depressions and insure maximum life and comfort, mattress manufacturers recommend rotating the mattress end for end and side to side every two weeks for the first three months and every sixty days thereafter.

Manually moving and turning a large mattress is an awkward procedure. Most new mattresses are constructed without handles for turning or carrying to avoid problems caused by handles tearing loose from the soft bedding materials. Even when a mattress is equipped with handles, they exert tension on the mattress at only one point about the periphery, making it difficult to control the movement of the mattress during turning or carrying.

Accordingly, a need exists for a mattress carrying harness which can be attached to a mattress to provide secure handholds at several points about the periphery for one or more persons to grip when turning or carrying the mattress, and which distributes the tension exerted at a handhold over a greater portion of the mattress to improve control during turning or carrying.

SUMMARY OF THE INVENTION

In accordance with the invention, there is provided a carrying harness having two flexible belts of substantially equal length formed into two separate elongated continuous loops by having their own ends fastened together. Two flexible connecting belts for each continuous loop are fastened between opposing points on the continuous loops so that the opposite ends of each continuous loop are formed into two spaced-apart corner loops. Each corner loop is adapted to fit over one of the mattress corners to provide lateral support during turning or carrying of the mattress. The two corner loops formed from a continuous loop are connected by two segments of the continous loop extending between the points where the connecting belts are fastened. These segments are adapted to lie along the edges of the mattress when the corner loops are fitted over the mattress corners. Two flexible end belts connect the ends of the continous loops so as to lie along the remaining edges of the mattress when the corner loops are fitted over the mattress corners and so that the harness encircles the periphery of the mattress during carrying or turning. The two end belts lying along opposite edges of the mattress are adjustable in length so the harness can be tensioned and tightened down on the mattress to provide secure handholds during carrying or turning.

In a particularly preferred embodiment, the two end belts also have releasable connectors in them, which allows the harness to be separated into two mated sections for easy removal from the mattress.

BRIEF DESCRIPTION OF THE DRAWINGS

FIG. 3 is a top view of a locking device used to connect sections of the mattress carrying harness of FIG. 1 in the unlocked position;

FIG. 4 is a top view of the locking device of FIG. 3 in the locked position;

FIG. 5 is a front view of the male component of the locking device of FIG. 3;

FIG. 6 is a front view of the female component of the locking device of FIG. 3; and FIG. 7 is a sectional view of a locking piece on the male component of FIG. 5 along line 7—7.

DETAILED DESCRIPTION

Figure 1:
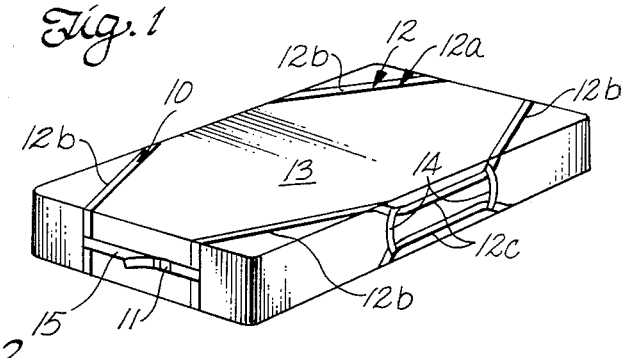
FIG. 1 is a pictorial view of a mattress carrying harness according to the present invention attached to a mattress.
Figure 1A:
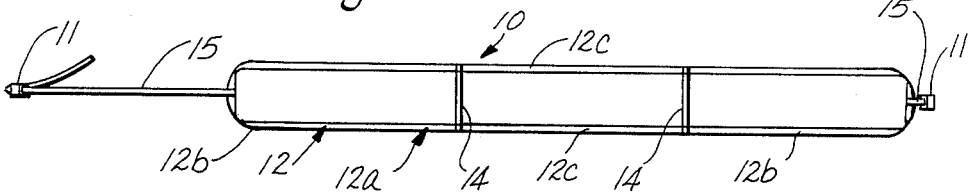
FIG 1A is a schematic view of one section of the mattress carrying harness of FIG. 1 in an unattached position.

With reference to FIGS. 1 and 1A, a mattress carrying harness 10 is comprised of two sections connected at opposite ends by a pair of locking devices 11. Each section has a long strap or belt 12 made of a sturdy, flexible material such as polypropylene or nylon webbing which is sewn or otherwise secured end to end to form a continuous major loop 12*a*. Two short, longitudinally spaced-apart connecting straps or belts 14, also made of a sturdy, flexible material such as polypropylene or nylon webbing, are sewn or otherwise secured between opposing points on major loop 12*a* to form two corner loops 12*b*. When these corner loops are fitted around adjacent corners of a mattress 13 the two segments of major loop 12*a* between connecting belts 14 form a pair of side belts 12*c* that rest along or near the edge or side of mattress 13.

Securely attached to corner loops 12*b* roughly opposite the side belts and at opposite ends of each harness section are end belts 15, which are also made of a sturdy, flexible material such as polypropylene or nylon webbing. In this position, the end belts extend out from the corner loops along opposite edges of mattress 13. When the mating harness sections are placed on opposite sides of mattress 13 their corresponding end belts extend out toward one another. Some overlap is provided in these corresponding end belts so that mattress carrying harness 10 can be used on mattresses of various widths.

While tying the corresponding end belts together is one way of securing the harness sections to mattress 13, the preferred embodiment uses locking devices 11. The securing means used should provide secure locking, ease in disconnection and ease in adjusting the combined lengths of the end belts to allow the mattress carrying harness to be secured on mattresses of various widths. One locking device which has these advantages is Fastex model QR-1. The releasable interconnection properties of this locking device are described in great detail in U.S. Pat. No. 3,167,835 issued to Bengtsson and are illustrated by FIGS. 3–6.

With reference to FIG. 3, locking device 11 has a male component 16 and a female component 17. The male component has an adjustable attachment portion 18 generally flat and rectangular in shape with a generally rectangular central hole 19 extending therethrough and an orthogonal shoulder 20 along one of its edges. Extending away from shoulder 20 along opposite sides of portion 18 are a pair of raised ribs 21. A locking piece 22, slidably attached to the opposite sides of portion 18, encircles these raised ribs and has an upper member 23 and a lower member 24 which extend across central hole 19 (FIG. 7). The end of an end belt 15 can be attached to portion 18 by threading it up into hole 19, from the side opposite shoulder 20, between the upper member and lower member of locking piece 22 up and back over the top of upper member 23 and then back down through hole 19 to rest on top of itself.

Female component 17 has a locking socket portion 29 and an attachment portion 30. Attachment portion 30 is a U-shaped piece wnose opposed ends are attached to a back edge 31 of the locking socket portion. A pair of raised ribs 32 extend out from back edge 31 along opposite sides of portion 30 to provide structural support. The end of an end belt 15 can be fixedly attached to portion 30 by looping it around the end of the U-shaped piece and fastening it to itself.

Thus, the corresponding ends of end belts 15 can be securely locked together by sliding the two components of locking devices 11 together, can be easily disconnected and can be easily adjusted to fit snugly on mattress 13 once the locking devices are in the locked position by pulling on the ends of the two end belts which are threaded through adjustable attachment portions 18. The locking pieces 22 will allow the end belts to be tightened down and will not loosen up if tension is put on the end belts because the locking piece will slide to the left, as shown in FIG. 4, pressing the lengths of end belt 15 against the back rim of the central hole preventing them from sliding.

Figure 2:
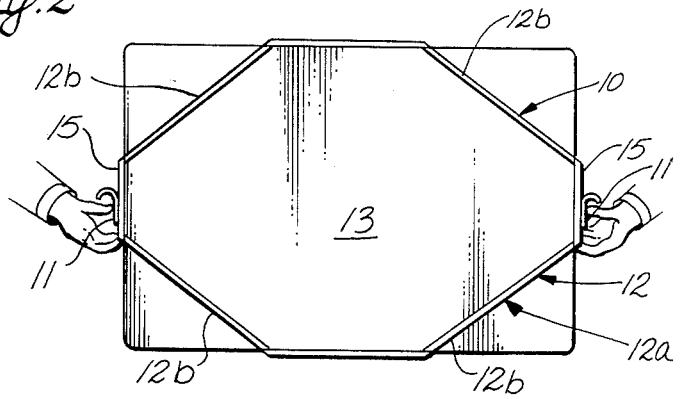
FIG. 2 is a top view of the mattress carrying harness of FIG. 1 as used to carry a mattress.

When the two sections of harness 10 have been tightened down on mattress 13, the belt and loop segments provide numerous handholds about its periphery which can be securely gripped for turning or carrying the mattress, as shown in FIG. 2. In addition, the harness extends completely around the mattress so that tension placed at one point on the harness will be widely distributed. The complete support given the mattress will also make it easier to control during turning or carrying. While harness 10 was developed with mattresses in mind, it is also contemplated that it could prove useful in moving other bulky objects, one example of which would be box springs.

What is claimed is:

1. A carrying harness, comprising:

two flexible belts of substantially equal length formed into two separate elongated continuous loops by having their own ends fastened together;

four flexible connecting belts, two of which are fastened between opposing points on each of the continuous loops so that the opposite ends of each continuous loop are formed into two spaced-apart corner loops adapted to fit over adjacent corners of an object to be carried, the corner loops being connected by two segments of the continuous loop extending between the fastening points of the connecting belts, the segments being adapted to lie along the edges of the object to be carried when the corner loops are fitted over the corners of the object;

two flexible end belts connecting the ends of the continuous loops so as to lie along the remaining edges of the object to be carried when the corner loops are fitted over the corners of the object; and means for adjusting the length of the two end belts.

2. A carrying harness as described in claim 1 where each of the two end belts are releasably joined at the means for adjusting their length.

3. A harness for carrying a generally rectangular mattress having a top side, a bottom side, two long edges opposite one another and two short edges opposite one another, the harness comprising:

two flexible belts of substantially equal length formed into two separate elongated continuous loops by having their own ends fastened together;

four flexible connecting belts, two of which are fastened between opposing points on each of the continuous loops so that the opposite ends of each continuous loop are formed into two spaced-apart corner loops, each corner loop adapted to fit over one set of the four pairs of mattress corners formed by the interception of the top side with one end of a long edge and one end of a short edge and the interception of the bottom side with the same end of the same long edge and the same end of the same short edge and thereby provide lateral support for the mattress during carrying, the two corner loops being connected by two segments of the continuous loop extending between the fastening points of the connecting belts, the segments being adapted to lie along the long edges of the mattress to be carried when the corner loops are fitted around the four pairs of corners;

two flexible end belts connecting the ends of the continuous loops so as to lie along the short edges of the mattress to be carried when the corner loops are fitted around the four pairs of corners; and means for adjusting the length of the two end belts.

4. A carrying harness as described in claim 3 where each of the two end belts are releasably joined at the means for adjusting their length.

* * * * *